US008424244B2

(12) United States Patent
Tarrega Lloret

(10) Patent No.: US 8,424,244 B2
(45) Date of Patent: Apr. 23, 2013

(54) SIMULTANEOUS DISPLACEMENT DEVICE FOR SLIDING DOORS

(75) Inventor: Miguel Angel Tarrega Lloret, Barcelona (ES)

(73) Assignee: Klein Iberica, S.A., Montcada I Reixac, Barcelona (ES)

( * ) Notice: Subject to any disclaimer, the term of this patent is extended or adjusted under 35 U.S.C. 154(b) by 199 days.

(21) Appl. No.: 12/762,109

(22) Filed: Apr. 16, 2010

(65) Prior Publication Data

US 2010/0281776 A1 Nov. 11, 2010

(30) Foreign Application Priority Data

Apr. 16, 2009 (ES) ..... 200900999

(51) Int. Cl.
*E06B 3/46* (2006.01)

(52) U.S. Cl.
USPC ..... 49/118; 49/123

(58) Field of Classification Search ..... 49/116, 49/117, 118, 123
See application file for complete search history.

(56) References Cited

U.S. PATENT DOCUMENTS

| | | | | |
|---|---|---|---|---|
| 1,534,210 | A * | 4/1925 | Griffith et al. | 49/102 |
| 2,425,016 | A * | 8/1947 | Weaver | 49/102 |
| 4,259,810 | A * | 4/1981 | West | 49/118 |
| 4,781,270 | A | 11/1988 | Holland | |
| 5,711,112 | A * | 1/1998 | Barten et al. | 49/118 |
| 5,827,143 | A * | 10/1998 | Monahan et al. | 474/73 |
| 6,179,742 | B1 * | 1/2001 | Haag et al. | 475/154 |
| 6,193,040 | B1 * | 2/2001 | Cerny | 192/84.961 |
| 6,352,097 | B1 | 3/2002 | Kern et al. | |
| 6,360,487 | B1 * | 3/2002 | Kern et al. | 49/231 |
| 6,923,238 | B2 * | 8/2005 | Kern et al. | 160/197 |
| 7,290,369 | B2 * | 11/2007 | Tarrega Lloret | 49/123 |
| 7,506,727 | B2 * | 3/2009 | Spiess | 187/340 |
| 2002/0092235 | A1 * | 7/2002 | Kern et al. | 49/121 |
| 2002/0157317 | A1 * | 10/2002 | Valencia et al. | 49/360 |
| 2004/0049984 | A1 * | 3/2004 | Pfaff | 49/116 |
| 2004/0172882 | A1 * | 9/2004 | Kern et al. | 49/231 |
| 2005/0160672 | A1 * | 7/2005 | Tarrega Lloret | 49/118 |
| 2006/0174540 | A1 * | 8/2006 | Oberleitner | 49/118 |

FOREIGN PATENT DOCUMENTS

| | | |
|---|---|---|
| DE | 94 16 316 | 3/1996 |
| EP | 1 544 399 | 6/2005 |

OTHER PUBLICATIONS

European Search Report for EP 10 38 0056 mailed Nov. 9, 2010.

* cited by examiner

*Primary Examiner* — Katherine Mitchell
*Assistant Examiner* — Justin Rephann
(74) *Attorney, Agent, or Firm* — Merchant & Gould P.C.

(57) ABSTRACT

Simultaneous displacement device for sliding doors, being a first sliding leaf (7) joined to a first cogged belt (9) established between a first set of cogged pulleys (11) and (12) which rotate freely on a first axis (13) and second axis (14) respectively, and a second sliding leaf (8) joined to a second cogged belt (10) established between a second set of cogged pulleys (15) and (16) which rotate freely on said first axis (13) and second axis (14) respectively, said device comprising clutching means (2) which enable to adopt a first position where the first cogged belt (9) and the second cogged belt (10) move independently, and a second position where the first cogged belt (9) and the second cogged belt (10) move integrally to enable the simultaneous displacement of the first sliding leaf (7) and of the second sliding leaf (8).

12 Claims, 14 Drawing Sheets

SIMULTANEOUS DISPLACEMENT DEVICE FOR SLIDING DOORS

This application claims benefit of Serial No. 200900999, filed 16 Apr. 2009 in Spain and which application is incorporated herein by reference. To the extent appropriate, a claim of priority is made to the above disclosed application.

OBJECT OF THE INVENTION

The present invention refers to a simultaneous displacement device for sliding doors comprising, both two sliding leaves which slide in the same direction and sense and three and four sliding leaves which slide in the opposite direction to the first two leaves in a synchronized manner. All the main elements which configure the device are integrated in an upper guide with easy installation and mounting.

The present invention is especially suitable for applying it in glass sliding doors which are manually run with respect to fixed enclosures or panels which frame an open passage area assisted by said door.

BACKGROUND OF THE INVENTION

There are known simultaneous displacement devices for sliding doors with only two sliding leaves, both with the ability to simultaneously move in the same direction and sense. To that end, the first sliding leaf is hung from an upper guide through a couple of moving carriages which slide inside it and from which there hang skids integral to a bearing profile holding said leaf. The second sliding leaf is hung in the same way through a second upper guide parallel to the first leaf. In order to carry out the simultaneous displacement of both leaves, the first one of them features a cogged belt arranged between two pulleys integral to the bearing profile. Each one of the pulleys is located at one of the side ends of the first sliding leaf, so that the belt extends along the whole width thereof. The belt is engaged at a fixed point of reference, generally a part anchored to the ceiling, next to the upper guides, while the second sliding leaf is engaged to said belt. In this way, when the sliding of the second sliding leaf starts to pull from the belt of the first leaf, which, as it is anchored to a fixed point, in turn pulls from one of the pulleys thus producing the simultaneous displacement of both sliding leaves.

The simultaneous displacement device described above has important limitations and inconveniences. The main limitation is that it only allows the simultaneous sliding of two sliding leaves running in the same direction and sense. That is, it does not work with sliding doors the leaves of which run in a synchronized manner in opposite senses. This limitation makes the device described above to be intended to a limited number of applications or uses. Specifically, for its application or use in sliding doors which have a relatively small free passage width. As regards the inconveniences, it is noted the mounting complexity of the device described above, since it implies both the installation of an upper guide for each one of the two sliding leaves and the installation of the anchoring part of the cogged belt, among other elements.

In the field of sliding doors for lifts are known other simultaneous displacement devices, such as those ones described in DE9416316 and U.S. Pat. No. 4,781,270. Those sliding doors comprise a first and a second sliding leaves hung from an upper guide, and which have the ability to run in its direction. Their simultaneous displacement devices comprise a first cogged belt enabled for the union of the first sliding leaf, by means of brackets or support frames. The first and the second cogged belt are established between a first set and a second set of cogged pulleys respectively. The first set and the second set of pulleys are fixed on a first and a second axis respectively, so the sliding doors never move separately.

The present invention solves the problems described above in a fully satisfactory manner thanks to a device which has great application flexibility and simplicity. Specifically, the device of the present invention allows both the simultaneous displacement of two sliding leaves moving in the same direction and sense, and the simultaneous sliding of three and four sliding leaves running in the opposite sense to that of the two first leaves in a synchronized manner. All main elements configuring the device are integrated in an upper guide with easy installation and mounting.

SUMMARY OF THE INVENTION

In order to solve the aforementioned problems, the simultaneous displacement device for sliding doors of the present invention is integrated in an upper guide from which there are hung a first and second sliding leaves. Both sliding leaves have the ability to slide in the upper guide direction, thanks to the use of fastening clamps having rolling means which slide on tracks arranged inside said upper guide.

The device of the present invention comprises a first cogged belt enabled for the union of the first sliding leaf. The first cogged belt is established between the first set of cogged pulleys which rotate freely on a first axis and second axis respectively, where said first and second axes are integral to the upper guide. The device of the present invention also comprises a second cogged belt enabled for the union of the second sliding leaf and some clutching means. Preferably, the union of the sliding leaves to the cogged belts is carried out through the use of connection parts, which are fixed at one of their ends to clamps while at the other end they hold the belts.

The second cogged belt is established between a second set of cogged pulleys which rotate freely on the first axis and the second axes respectively.

In turn, the clutching means enable to adopt a first position where the first cogged belt and the second cogged belt move independently, and a second position where the first cogged belt and the second cogged belt move integrally.

The first position enables the first and second sliding leaves to move separately. This first position plays an important role during mounting and maintenance operations. Specifically, it enables to adjust the final position of the sliding doors, once they are fixed to the corresponding cogged belts, thus obtaining the desired overlapping. Such overlapping can be produced either between the sliding leaves themselves or between the sliding leaves and the enclosures or fixed panels where they are set.

The second position enables the first and second sliding leaves to run simultaneously in the same direction and sense; this sense which can be the sense corresponding to the door opening or the one corresponding to the closing of the door. The displacement speeds of the first and second sliding leaves adjust for each one of them according to the diameter of the first set of cogged pulleys and to the diameter of the second set of cogged pulleys respectively. Taking the example that the first sliding leaf is the closest to the final point and that its path is half the path of the second sliding leaf, for both of them to start and finish their displacement simultaneously it is necessary for the second one to move at twice the speed of the first. To that end, the pulleys of the first set present half the diameter of the pulleys of the second set. It is also possible that there exist other path relations between the first and second sliding leaves. In any case, in order to avoid undesired overlapping or gaps between leaves once the door is open or closed, it is necessary to adjust the sliding speed of each sliding leaf in a correct manner through the diameters of the first and second pulley sets.

There exist multiple solutions to clutch and unclutch the first and second cogged belts, which gives place to the first and second position respectively. However, the clutching means of the present invention comprise a wheel which rotates freely on one of the axes and which has blocking means which enable to integrate their movement with that of the cogged pulleys arranged in the same axis. The wheel is comprised between two cogged pulleys of the same axis. The blocking means comprise one or more through holes coinciding with blocking holes drilled on the cogged pulleys, between which at least one through element is inserted, for example, a cotter pin, pin or screw, among other elements. In order to facilitate the clutching or unclutching of the device, the pulleys have multiple blocking holes forming a circle which is concentric to the pulley axis. Thus, with small rotations applied on the pulleys and on the cogwheel, the blocking holes are easily made to coincide with the through hole.

Additionally, the wheel comprises a continuous perimeter groove which engages with one or more protruding elements arranged on the pulleys of the first set or of the second set, without said engaging limiting the relative movement between the wheel and the corresponding pulley, that is, the protruding element slides freely inside the continuous perimeter groove. Likewise, the wheel also comprises one or more discontinuous perimeter grooves, arranged on the opposite face of the continuous perimeter groove, which engage with the protruding elements of the pulleys of the first set or of the second set and which block the relative movement between the wheel and the corresponding pulley.

Additionally, the wheel also comprises one or more flexible protruding pivots, the end of which coincides with a plurality of holes arranged concentrically in the pulleys of the first set or of the second set. This enables to precisely face the blocking means to facilitate the insertion of the through element.

Preferably, the wheel also comprises a cogged profile.

The axes can be reinforced by reinforcement pieces which are joined to the lower end of the axis and which present a separating element which avoids the derailment of the second cogged belt.

The configuration of the previously described simultaneous displacement device for sliding doors is associated to a preferred embodiment, which is non-limiting for the present invention. However, it can be obviously concluded that the device of the present invention can be applied in sliding doors having more than two sliding leaves, where all of them have the ability to displace in the same direction and sense. This is attained adding, for each leaf additional to the second, a new cogged belt established between a new set of cogged pulleys which rotate freely on the first axis and the second axis respectively. At the same time, said pulleys are integrated through clutching means such as the one described. As in the preferred embodiment, the displacement speeds of each sliding leaf are adjusted through diameters of each set of cogged pulleys.

According to a second preferred embodiment of the present invention, the device comprises a third cogged belt enabled to join a third sliding leaf, said third cogged belt is established between a third set of cogged pulleys which rotate freely on a third and fourth axes, respectively, where said third and fourth axes are integral to the upper guide, being the movement of the third cogged belt synchronized and opposite to the movement of the first cogged belt. Through this configuration, it is possible for the first and third sliding leaves to run in a synchronized manner in opposite senses and simultaneously together with the second sliding leaf.

In order to avoid the derailment of the first and third cogged belts, the device of the present invention comprises a bar integral to the upper guide, arranged in front of the first and third axes at the level of the first cogged belt and of the third cogged belt. Besides, the aforementioned reinforcement part is joined to the lower end of the first and third axes to provide stiffness to both axes and absorb efforts thereon, ensuring that the gear mechanism enabling the synchronism is maintained at all times.

According to a third preferred embodiment of the present invention, the device also comprises a fourth cogged belt enabled to join a fourth sliding leaf and second clutching means.

The fourth cogged belt is established between a fourth set of cogged pulleys which rotate freely on the third axis and the fourth axis respectively.

In turn, the second clutching means enable to adopt a third position where the third cogged belt and the fourth cogged belt move independently, and a fourth position where the third cogged belt and the fourth cogged belt move integrally to allow the simultaneous displacement of the third sliding leaf and of the fourth sliding leaf. Said third and fourth positions are equivalent to the first and second position, respectively. Through this configuration it is possible for the first and second sliding leaves to run in a sense opposite to the third and fourth sliding leaves, all of them simultaneously.

The second clutching means comprise a second wheel which rotates freely on the third or fourth axis and which has second blocking means which enable to integrate their movement to that of the cogged pulleys arranged on the same axis. The second wheel has the same characteristics than the cogwheel described above. Likewise, the second blocking means are equivalent to the blocking means described above.

Preferably, in order to take advantage of the maximum performance of the present invention, the synchronism of the third cogged belt and of the first cogged belt, both in the second and in the third embodiments, is carried out placing the wheels of the first and second clutching means on the first axis and on the third axis respectively, and engaging the cogged profile of both wheels.

BRIEF DESCRIPTION OF THE DRAWINGS

The following is a brief description of a series of drawings which will help understand the invention better, clearly relating to three embodiments of said invention which is presented as a non-limiting example thereof.

DETAILED DESCRIPTION OF THE PREFERRED EMBODIMENTS

Figure 1:
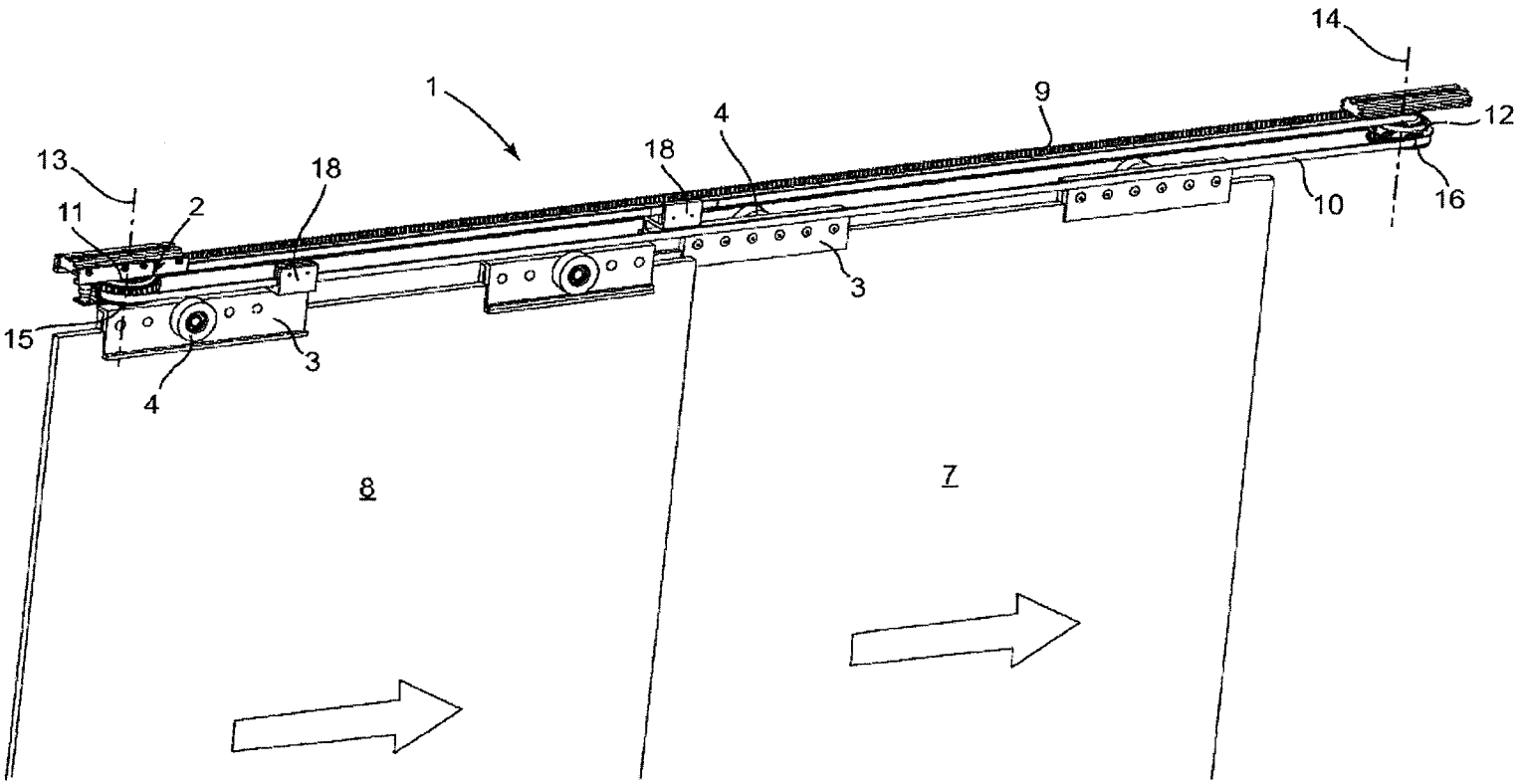
FIGS. 1 and 1B are perspective views in a second position and a first position of the device of the present invention according to a preferred embodiment.
Figure 1B:
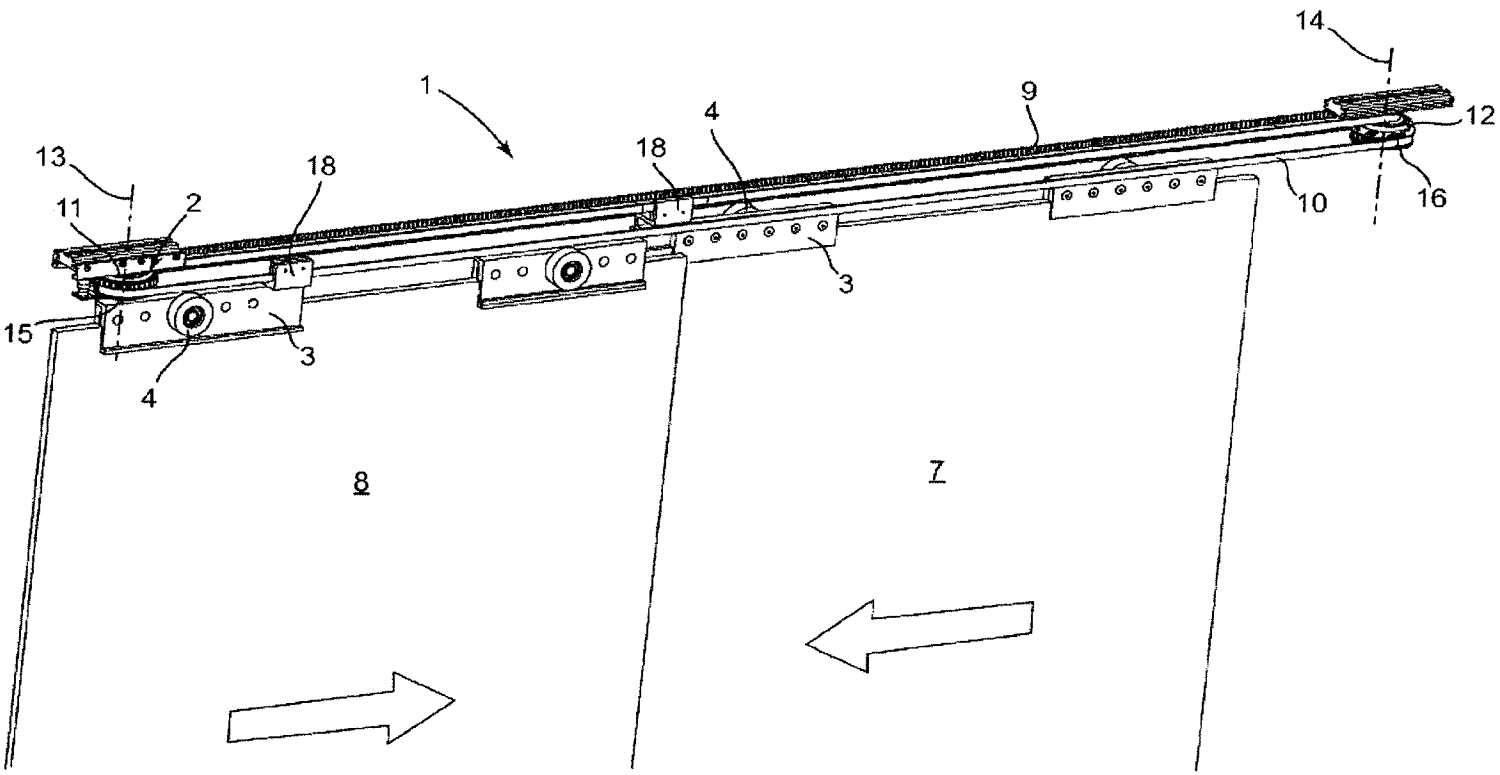
Figure 2:
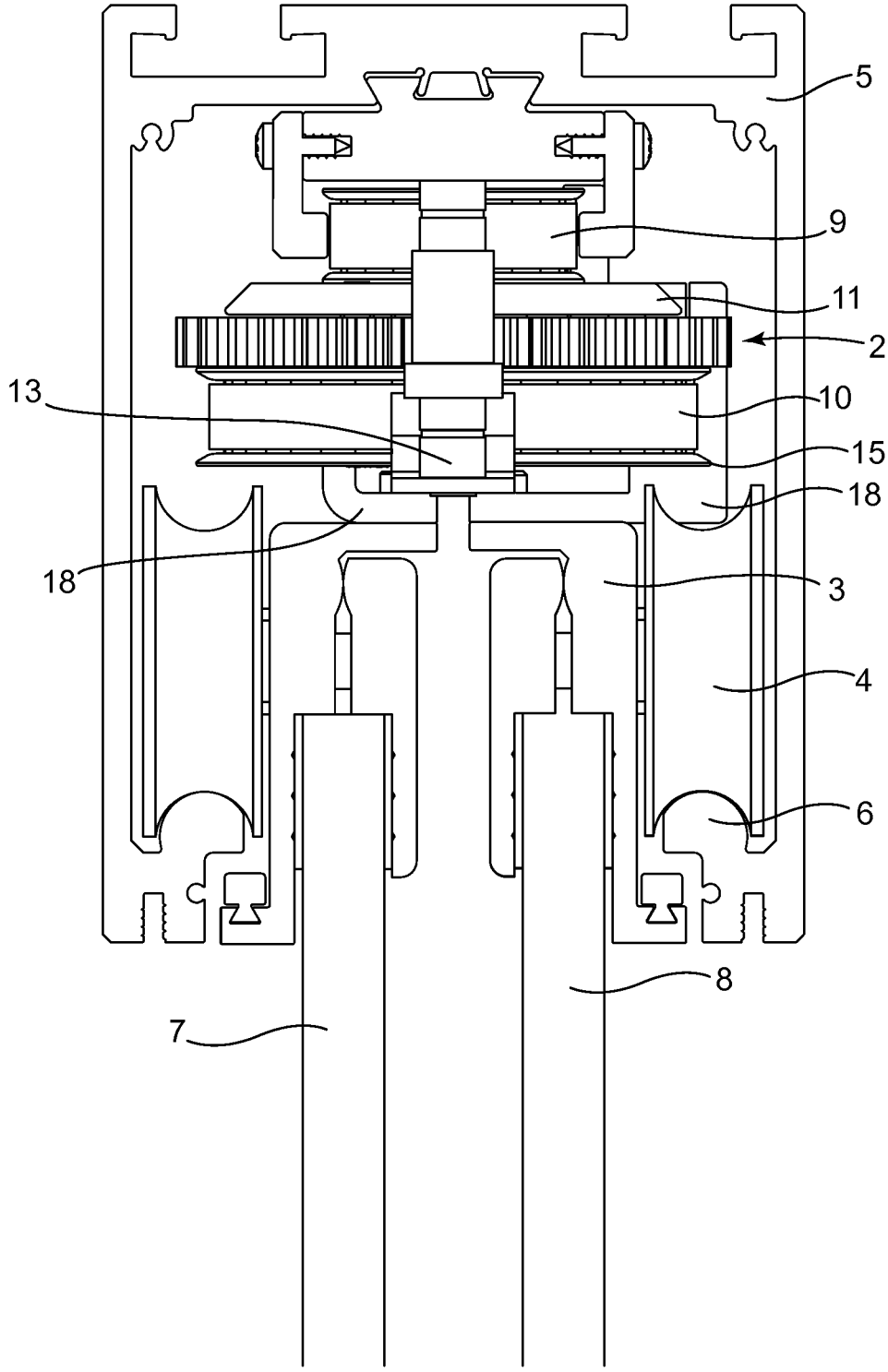
FIG. 2 is a sectional view of the upper guide according to a first preferred embodiment.

FIG. 1 shows a perspective view of the simultaneous displacement device (1) for sliding doors of the present invention according to a first preferred embodiment. As it can be seen, the sliding door has a first sliding leaf (7) and a second sliding leaf (8) hung from an upper guide (5), not shown in this figure. Both sliding leaves (7) and (8) have the ability to run in the direction of the upper guide (5), thanks to the use of fastening clamps (3) having rolling means (4) which slide on tracks (6) arranged inside said upper guide (5). FIG. 2 shows a sectional view of the upper guide (5) where it can be seen how the different components of the present invention are integrated.

Again in FIG. 1, it can be seen that the device (1) of the present invention comprises a first cogged belt (9) enabled for the union of the first sliding leaf (7). The first cogged belt (9) is established between a first set of cogged pulleys (11) and (12) which rotate freely on a first axis (13) and second axis (14) respectively, where said first (13) and second axes (14) are integral to the upper guide (5). The device (1) of the present invention also comprises a second cogged belt (10) enabled for the union of the second sliding leaf (8) and some clutching means (2).

Preferably, the union of the sliding leaves (7, 8) to the cogged belts (9, 10) is carried out through the use of connection parts (18), which are fixed at one of their ends to the clamps (3) while at the other end they hold the corresponding belt (9, 10).

The second cogged belt (10) is established between a second set of cogged pulleys (15, 16) which rotate freely on the first axis (13) and the second axis (14) respectively.

In turn, the clutching means (2) enable to adopt; a first position where the first cogged belt (9) and the second cogged belt (10) move independently, and a second position where the first cogged belt (9) and the second cogged belt (10) move integrally.

Figure 3:
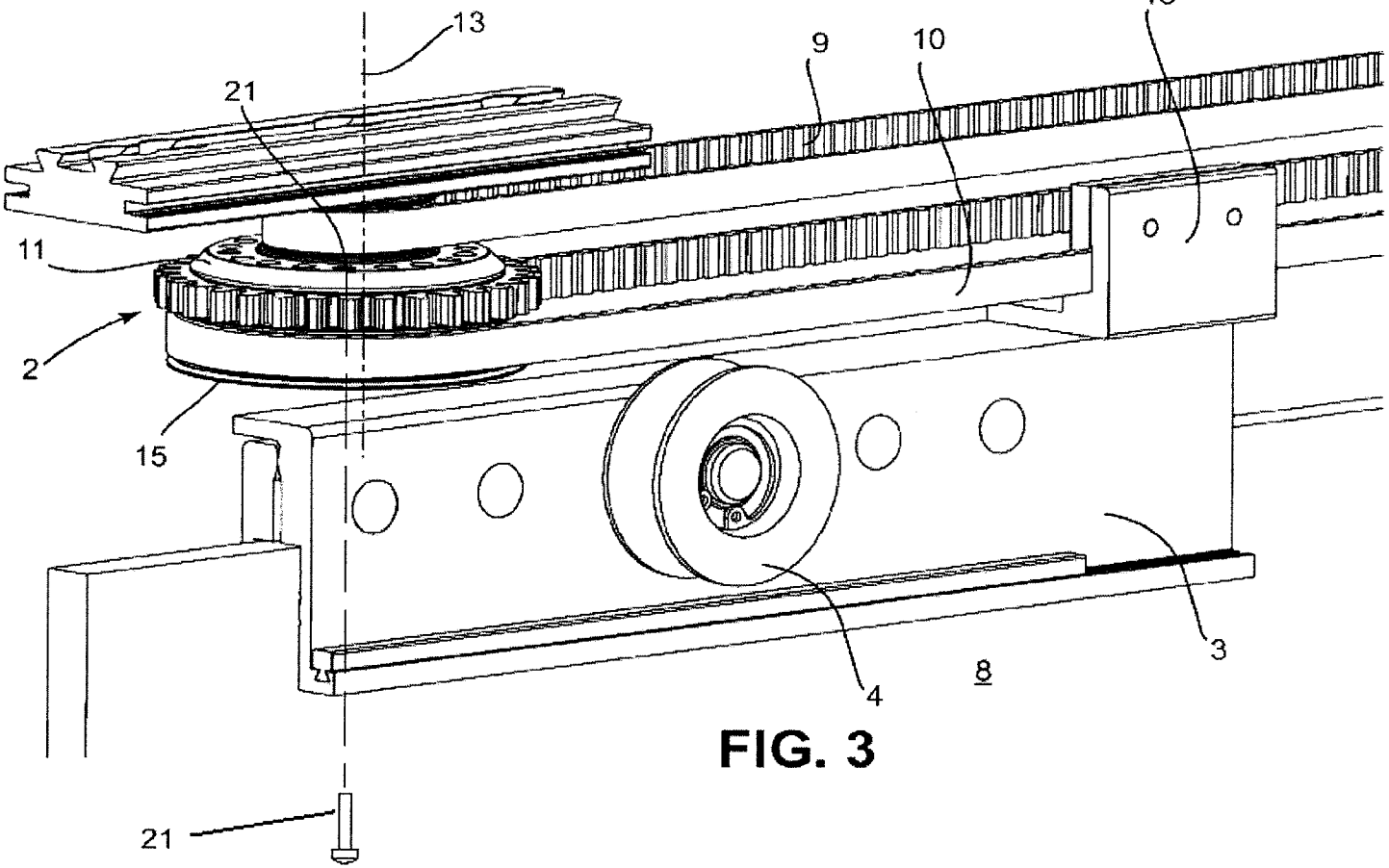
FIG. 3 is a perspective view of the first axis according to a first preferred embodiment.

FIG. 3 shows a perspective view of the first axis (13) according to a first preferred embodiment, where it can be seen in greater detail how the different components of said axis (13) are arranged. The clutching means (2) are in the second position, that is, they are integral to the first cogged belt (9) and the second cogged belt (10).

Figure 4:
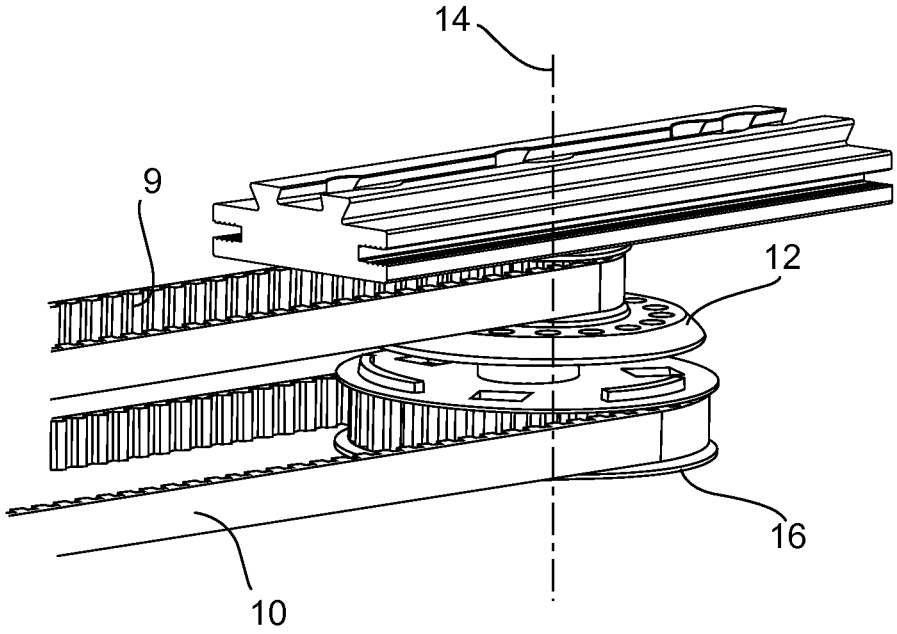
FIG. 4 is a perspective view of the second axis according to a first preferred embodiment.

FIG. 4 shows a perspective view of the second axis (14) according to a first preferred embodiment, where it can be seen in greater detail how the different components are arranged on said axis (14).

Figure 5:
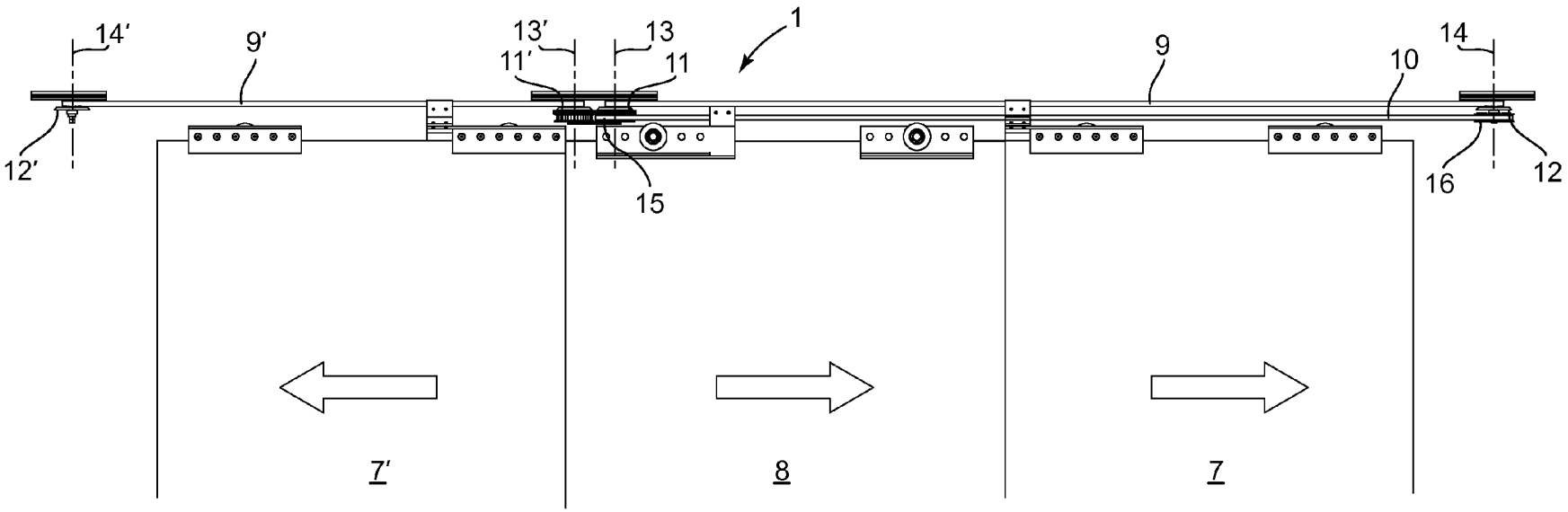
FIG. 5 is a perspective view of the device of the present invention according to a second preferred embodiment.

FIG. 5 shows a perspective view of the simultaneous displacement device (1) for sliding doors of the present invention according to a second preferred embodiment. As it can be seen the device (1) comprises a third cogged belt (9') enabled to join a third sliding leaf (7'), said third cogged belt (9') being established between a third set of cogged pulleys (11') and (12') which rotate freely on a third (13') and fourth (14') axes, respectively, where said third (13') and fourth (14') axes are integral to the upper guide (5), being the movement of the third cogged pulley (9') synchronized and opposite to the movement of the first cogged pulley (9). Through this configuration, it is possible for the first and third sliding leaves (7) and (7') to run in a synchronized manner in opposite senses and simultaneously together with the second sliding leaf (8).

Figure 6:
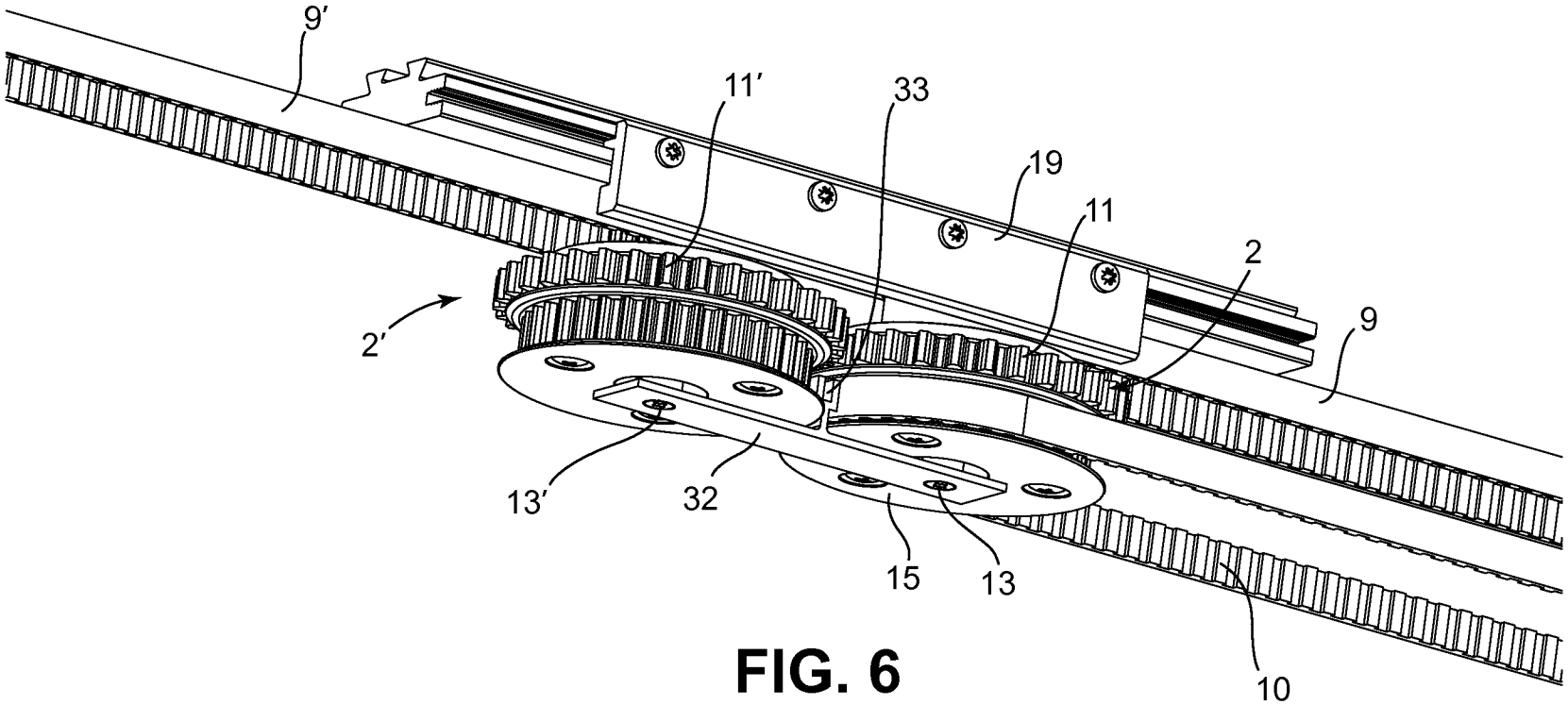
FIG. 6 is a perspective view of the first axis and of the third axis according to a second preferred embodiment.

FIG. 6 shows a perspective view of the first axis (13) and the third axis (13') according to a second preferred embodiment, in which it can be seen in greater detail how the elements of both axes (13, 13') interact.

In order to avoid the derailment of the first and third cogged belt (9) and (9'), the device (1) of the present invention comprises a bar (19) integral to the upper guide (5), arranged in front of the first and third axes (13) and (13') at the level of the first cogged belt (9) and of the third cogged belt (9). Besides, it can be seen a reinforcement part (32) joined to the lower end of the first and third axes (13) and (13') to provide stiffness to both axes (13, 13') and absorb efforts thereon, ensuring that the gear mechanism enabling the synchronism is maintained at all times. The reinforcement part (32) has a separating element (33) which avoids the derailment of the second cogged belt (10).

Figure 7:
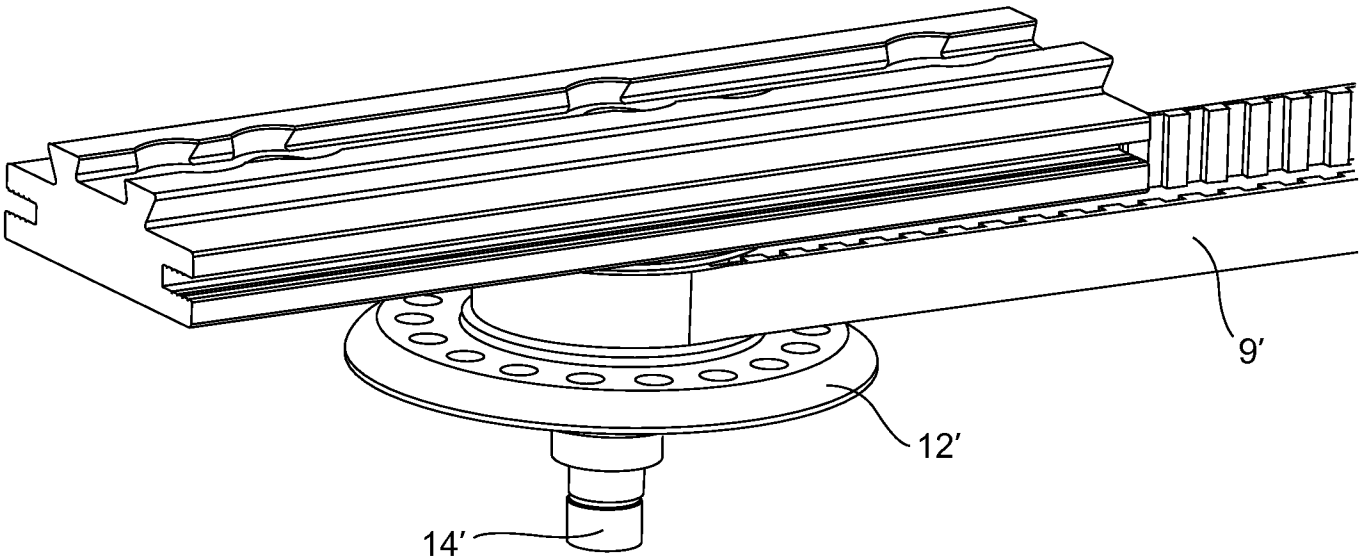
FIG. 7 is a perspective view of the fourth axis according to a second preferred embodiment.

FIG. 7 shows a perspective view of the fourth axis (14') according to a second preferred embodiment, where it can be seen in greater detail how the different components of said axis (14') are arranged.

Figure 8:
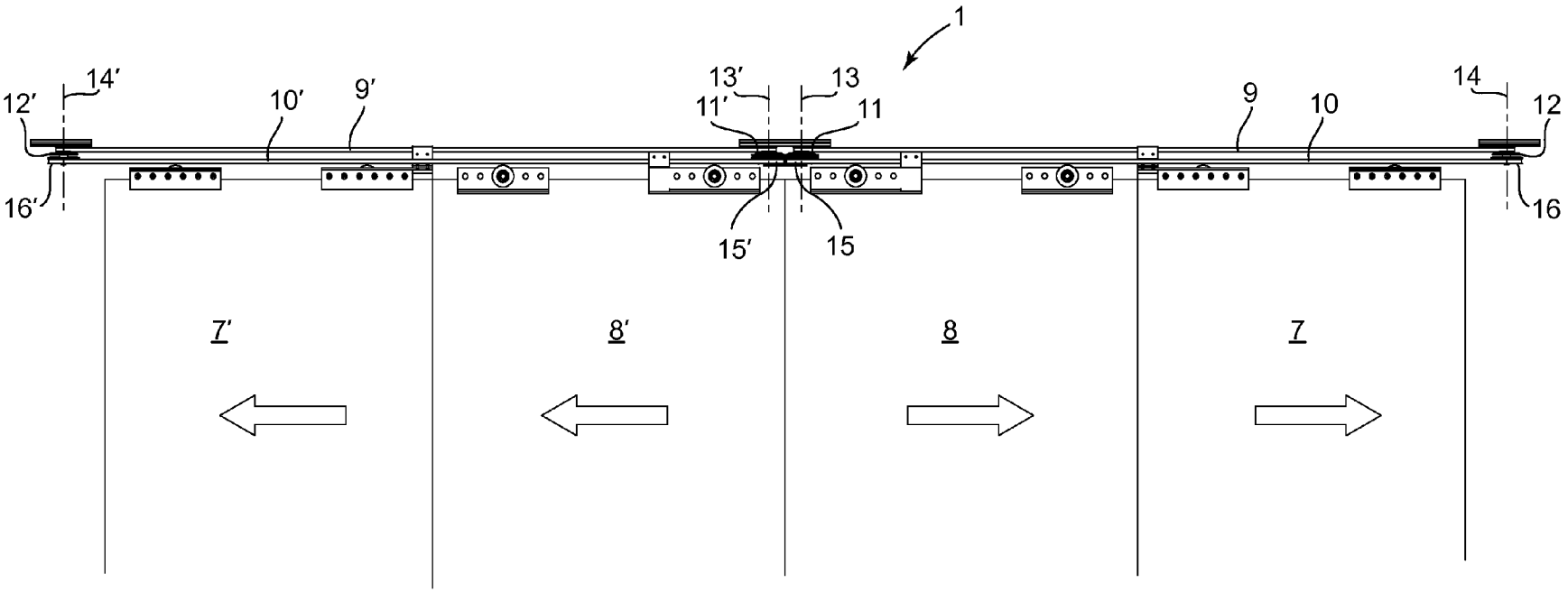
FIG. 8 is a perspective view of the device of the present invention according to a third preferred embodiment.

FIG. 8 shows a perspective view of the simultaneous displacement device (1) for sliding doors of the present invention according to a third preferred embodiment. As it can be seen, the device (1) comprises a fourth cogged belt (10') enabled to join a fourth sliding leaf (8') and second clutching means (2').

The fourth cogged belt (10') is established between a fourth set of cogged pulleys (15') and (16') which rotate freely on the third axis (13') and the fourth axis (14') respectively. In turn, the second clutching means (2') enable to adopt a third position where the third cogged belt (9') and the fourth cogged belt (10') move independently, and a fourth position where the third cogged belt (9') and the fourth cogged belt (10') move integrally to allow the simultaneous displacement of the third sliding leaf (9') and of the fourth sliding leaf (10'). Through this configuration it is possible for the first and second sliding leaves (7) and (8) to run in a sense opposite to the third and fourth sliding leaves (7') and (8'), all of them simultaneously.

Figure 9:
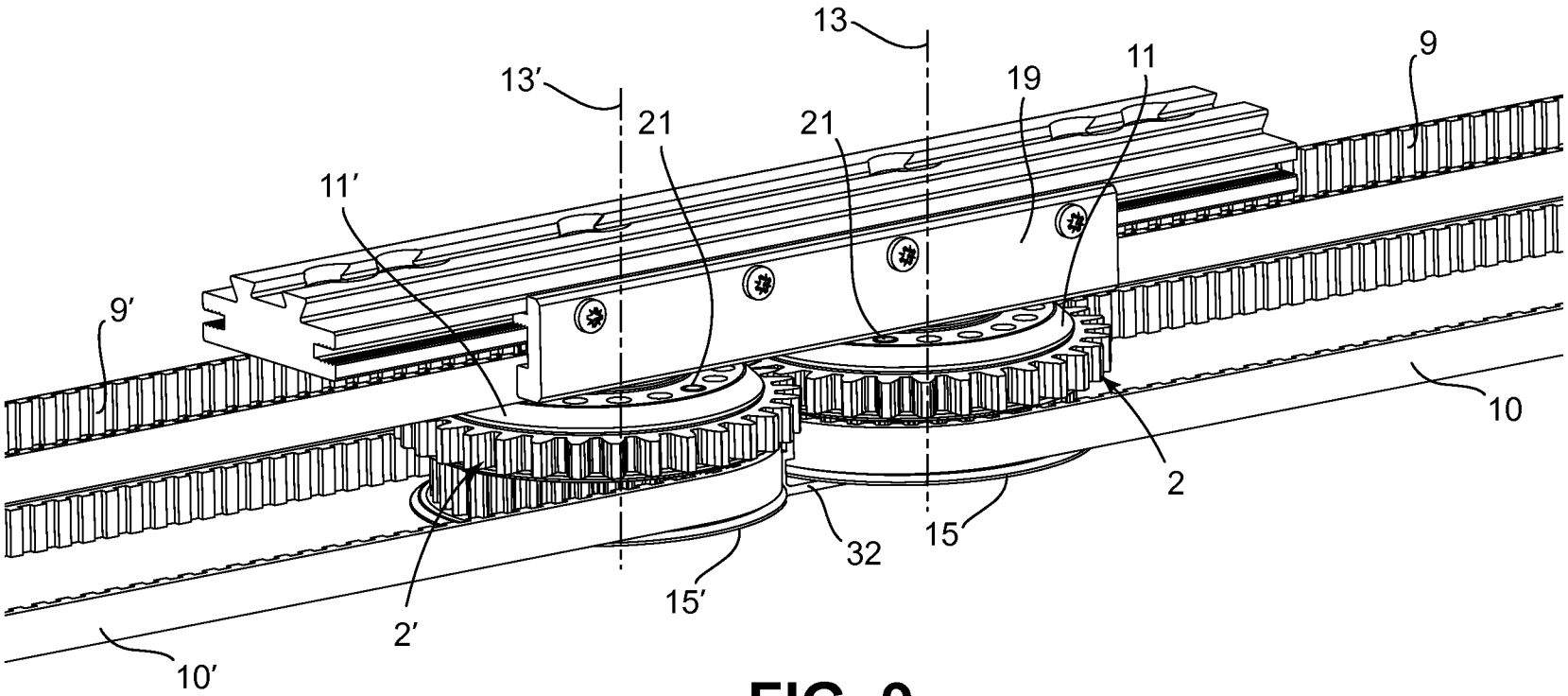
FIG. 9 is a perspective view of the first axis and of the third axis according to a third preferred embodiment.

FIG. 9 shows a perspective view of the first axis (13) and of the third axis (13') according to a third preferred embodiment, where it can be seen in greater detail how the elements of both axes (13, 13') interact.

Figure 10:
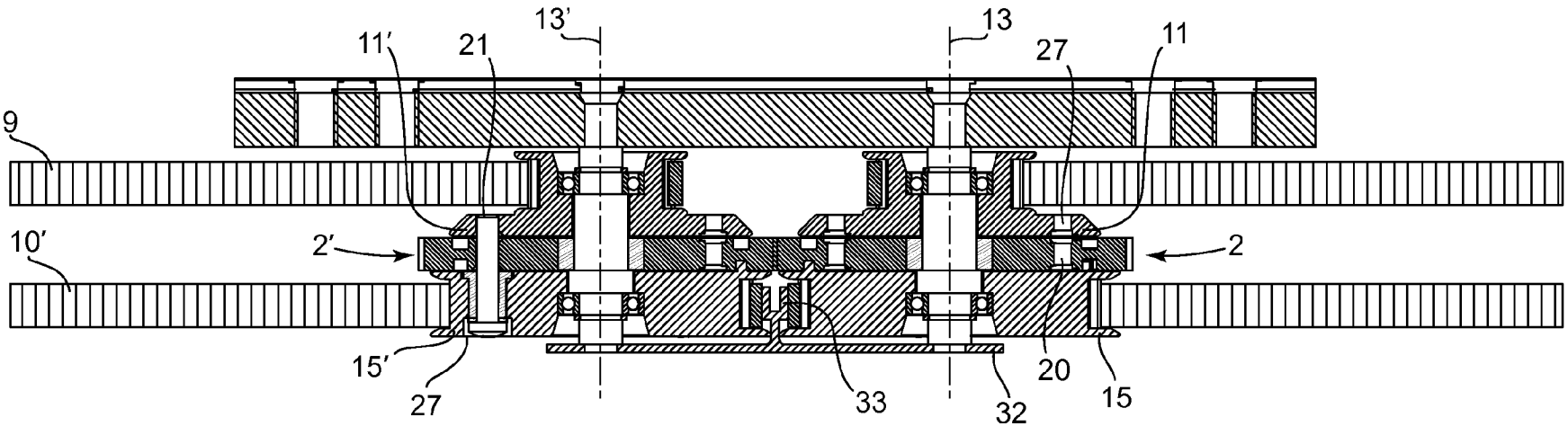
FIG. 10 is a sectional elevated view of the first axis and of the third axis according to a third preferred embodiment.

FIG. 10 shows a sectional elevated view of the first axis (13) and of the third axis (13') according to a third preferred embodiment.

Figure 11A:
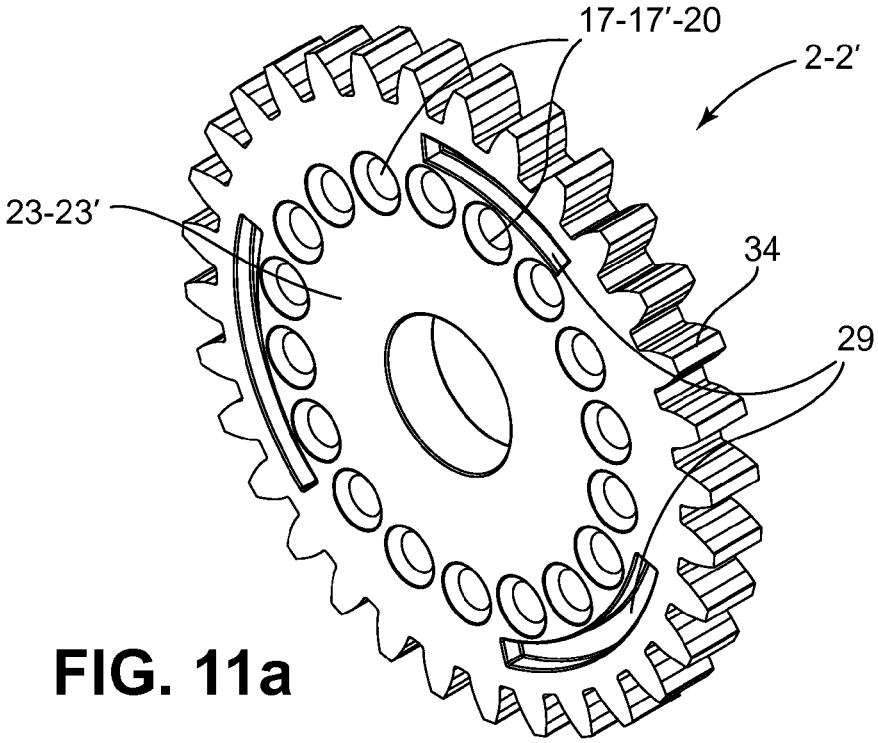
FIG. 11*a* is a perspective view of a first configuration example of the clutching means.

FIG. 11*a* shows a perspective view of a configuration example of the clutching means (2, 2'), where it can be seen that they comprise a wheel (23, 23') and blocking means (17, 17'). The blocking means comprise one or more through holes (20) coinciding with blocking holes (27) drilled on the cogged pulleys (11, 11', 12, 12', 15, 15', 16, 16') between which at least one through element (21) is inserted.

Additionally, the wheel (23, 23') comprises a continuous perimeter groove (28) which couples with one or more protruding elements (30) arranged on the pulleys (11, 11', 12, 12', 15, 15', 16, 16'), without said coupling limiting the relative movement between the wheel (23, 23') and the corresponding pulley (11, 11', 12, 12', 15, 15', 16, 16'), that is, the protruding element (30) slides freely inside the continuous perimeter groove (28). Likewise, the wheel (23, 23') also comprises one or more discontinuous perimeter grooves (29), arranged on the opposite face of the continuous perimeter groove (28), which couple with the protruding elements (30) of the pulleys (11, 11', 12, 12', 15, 15', 16, 16') and which block the relative movement between the wheel (23, 23') and the corresponding pulley (11, 11', 12, 12', 15, 15', 16, 16').

Figure 11B:
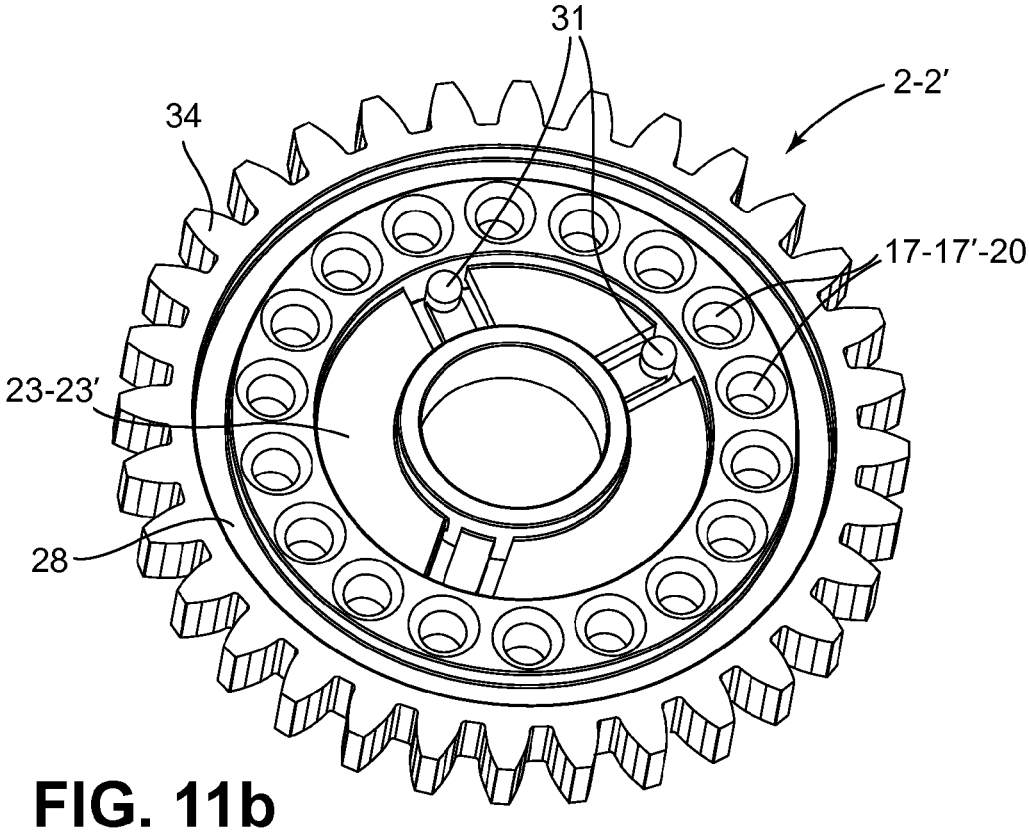
FIG. 11*b* is a perspective view of a second configuration example of the clutching means.

FIG. 11*b* shows a perspective view of a second configuration example of the clutching means (2,2'), where it can be seen that additionally the wheel also comprises flexible protruding pivots (31), the end of which coincides with a plurality of holes (32) arranged concentrically in the pulleys (11, 11', 12, 12', 15, 15', 16, 16').

Preferably, the wheel (23, 23') comprises a cogged profile (34) to enable the synchronism of the third cogged belt (9') and of the first cogged belt (9), both in the second and in the third embodiments, as it can be seen in greater detail in FIGS. 6 and 9.

Figure 12A:
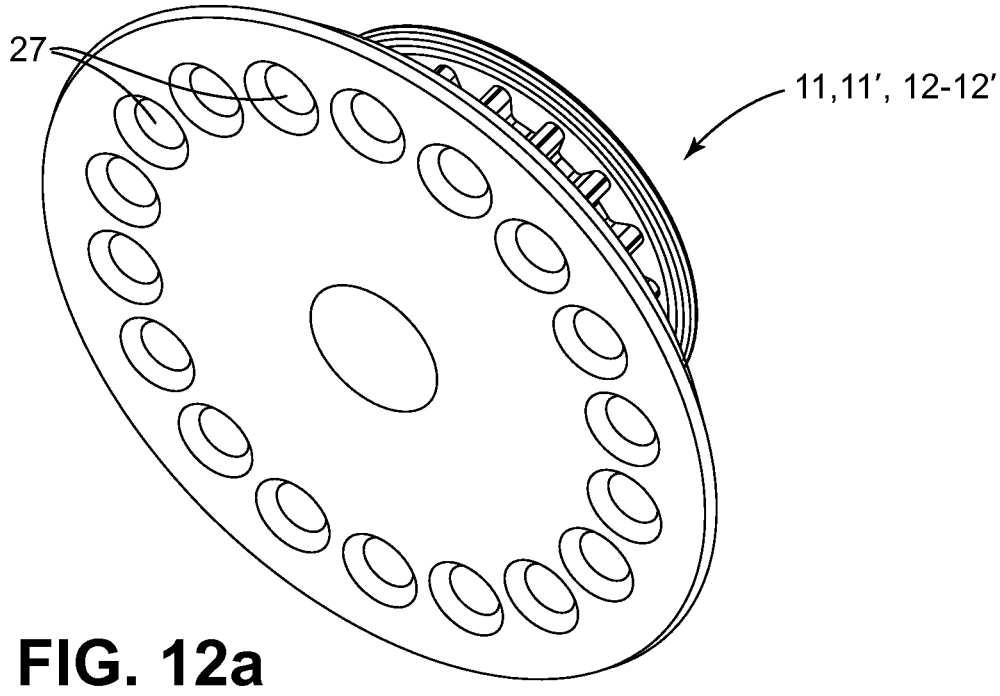
FIG. 12*a* is a perspective view of a first configuration example of one of the pulleys of the first set and of the third set.
Figure 12B:
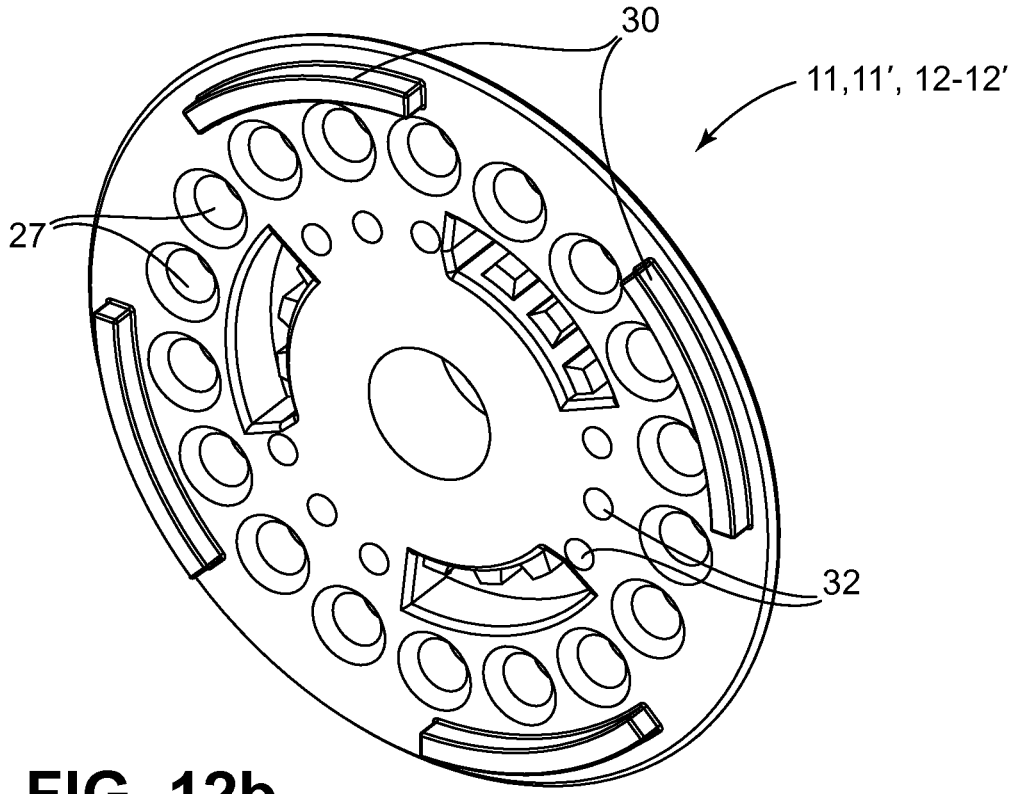
FIG. 12*b* is a perspective view of a second configuration example of one of the pulleys of the second set and of the fourth set.

FIGS. 12*a* and 12*b* show two configuration examples of the pulleys of the first and third sets (11, 12) and (11', 12'), where the aforementioned elements can be seen.

Figure 13A:
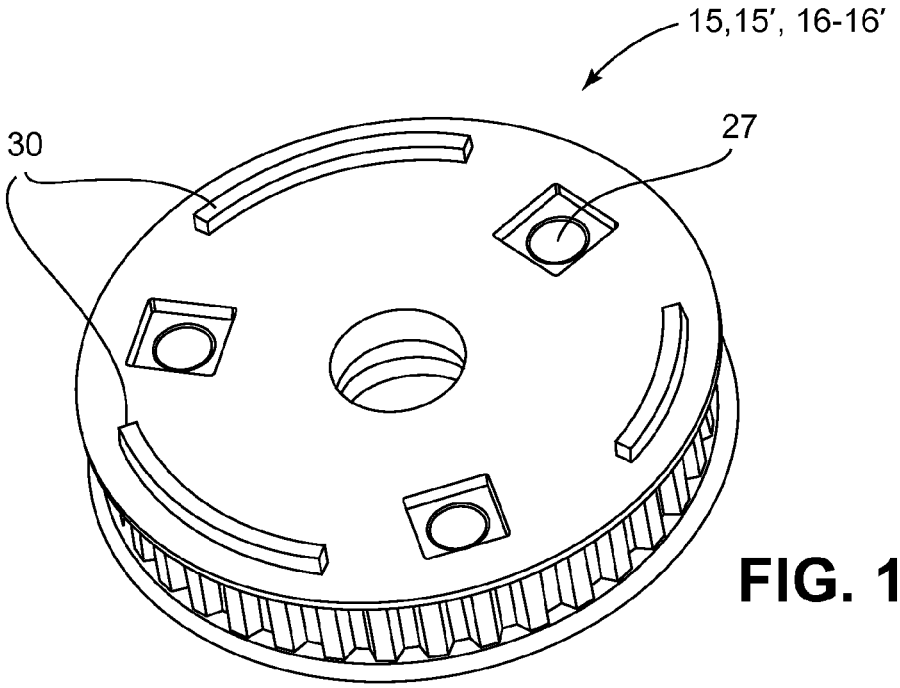
FIG. 13*a* is a perspective view of a first configuration example of one of the pulleys of the second set and of the fourth set.
Figure 13B:
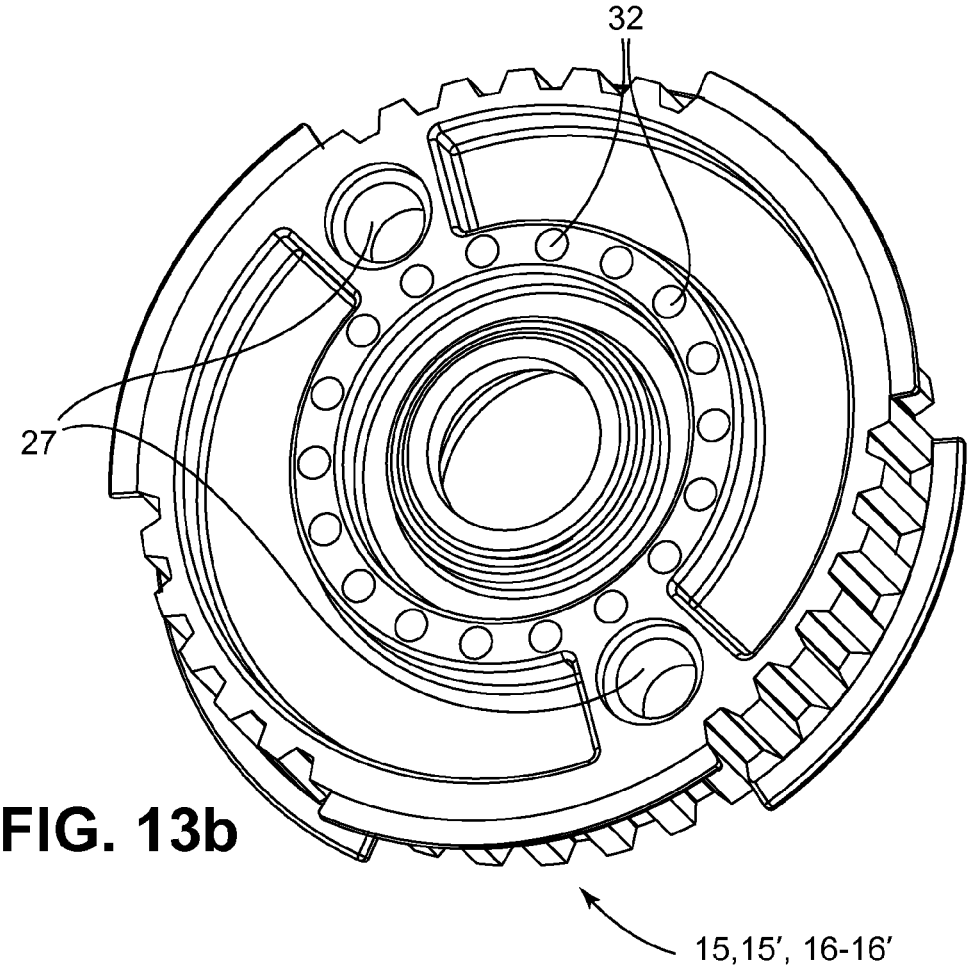
FIG. 13*b* is a perspective view of a second configuration example of one of the pulleys of the second set and of the fourth set.

FIGS. 13*a* and 13*b* show two configuration examples of the pulleys of the second and fourth sets (15, 16) and (15', 16'), where the aforementioned elements can be seen.

The invention claimed is:

1. Simultaneous displacement device for sliding doors, comprising a first sliding leaf and a second sliding leaf, the first sliding leaf and the second sliding leaf being hung from an upper guide, and being able to run in a same direction, wherein said device comprises:

a first cogged belt for union of the first sliding leaf, wherein said cogged belt is established between a first set of cogged pulleys which rotate freely on a first axis and second axis respectively, wherein said first and second axes are integral to the upper guide;

a second cogged belt for union of the second sliding leaf, wherein said second cogged belt is established between a second set of cogged pulleys which rotate freely on the first axis and second axis respectively;

clutching means comprising a wheel rotating freely on one of the axes, said wheel being intermediate the two cogged pulleys of the same axis, and having blocking means which enable integrated movement of said wheel, with movement of the cogged pulleys arranged on the same axis;

wherein the clutching means are configured for adopting:

a first position wherein the first cogged belt and the second cogged belt move independently, and a second position wherein the first cogged belt and the second cogged belt move integrally to enable the simultaneous displacement of the first sliding leaf and of the second sliding leaf.

2. Simultaneous displacement device for sliding doors according to claim 1, wherein displacement speeds of the first and second sliding leaves adjust for each of the first and second sliding leaves according to a diameter of the first set of cogged pulleys and to a diameter of the second set of cogged pulleys respectively.

3. Simultaneous displacement device for sliding doors according to claim 1, further comprising a reinforcement part joined to a lower end of one of the axes including a separating element which avoids derailment of the second cogged belt.

4. Simultaneous displacement device for sliding doors according to claim 1, further comprising a third cogged belt to join a third sliding leaf, said third cogged belt being established between a third set of cogged pulleys which rotate freely on a third axis and a fourth axis, respectively, wherein said third and fourth axes are integral to the upper guide, rotating movement of the third cogged pulley being synchronized and opposite to rotating movement of the first cogged pulley.

5. Simultaneous displacement device for sliding doors according to claim 4, further comprising a bar integral to the upper guide, arranged in front of the first and third axes and at a level of the first cogged belt and of the third cogged belt to avoid derailment.

6. Simultaneous displacement device for sliding doors according to claim 4, further comprising:

a fourth cogged belt to join a fourth sliding leaf, wherein said fourth cogged belt is established between a fourth set of cogged pulleys which rotate freely on a third and fourth axes, respectively, and second clutching means for adopting:

a third position wherein the third cogged belt and the fourth cogged belt move independently, and a fourth position wherein the third cogged belt and the fourth cogged belt move integrally to enable simultaneous displacement of the third sliding leaf and of the fourth sliding leaf.

7. Simultaneous displacement device for sliding doors according to claim 6, wherein the second clutching means comprise a second wheel which rotates freely on one of the axes and which has second blocking means which enable integrated movement to that of the cogged pulleys arranged on the same axis.

8. Simultaneous displacement device for sliding doors according to claim 4, wherein the wheel comprises a cogged profile.

9. Simultaneous displacement device for sliding doors according to claim 8, wherein the synchronism of the third cogged belt and of the first cogged belt is carried out placing the wheels on the first axis and on the third axis respectively, and engaging the cogged profile of both wheels.

10. Simultaneous displacement device for sliding doors according to claim 1, wherein the blocking means comprise a through hole coinciding with blocking holes drilled on the cogged pulleys between which a through element is inserted.

11. Simultaneous displacement device for sliding doors according to claim 1, wherein the wheel comprises:

a continuous perimeter groove which couples with a protruding element arranged on a first cogged pulley of the first set of cogged pulleys, without said coupling limiting relative movement between a cogwheel and the first cogged pulley; and a discontinuous perimeter groove, arranged on an opposite face where the continuous perimeter groove is located, which couples with the protruding element of the first cogged pulley and which blocks the relative movement between the cogwheel and the first cogged pulley.

12. Simultaneous displacement device for sliding doors according to claim 1, wherein the wheel comprises a flexible protruding pivot, the end of which coincides with a plurality of holes arranged concentrically in the cogged pulleys.

* * * * *